United States Patent [19]

Birkle et al.

[11] 4,363,712

[45] Dec. 14, 1982

[54] DEVICE FOR GALVANIC PRECIPITATION OF ALUMINUM

[75] Inventors: Siegfried Birkle, Hoechstadt an der Aisch; Johann Gehring, Spardorf; Klaus Stoeger, Nuremberg, all of Fed. Rep. of Germany

[73] Assignee: Siemens Aktiengesellschaft, Berlin & Munich, Fed. Rep. of Germany

[21] Appl. No.: 318,812

[22] Filed: Nov. 6, 1981

[30] Foreign Application Priority Data

Nov. 28, 1980 [DE] Fed. Rep. of Germany ..... 3044975

[51] Int. Cl.[3] ..... C25D 17/06

[52] U.S. Cl. ..... 204/199; 204/200

[58] Field of Search ..... 204/199, 200, 212, 215

[56] References Cited

U.S. PATENT DOCUMENTS 4,176,034 11/1979 Stoger et al. ..... 204/200

4,265,726 5/1981 Herrnring et al. ..... 204/202

*Primary Examiner*—T. Tufariello

*Attorney, Agent, or Firm*—Hill, Van Santen, Steadman, Chiara & Simpson

[57] ABSTRACT

An improved galvanizing device for the galvanic precipitation of aluminum from an anhydrous, aprotic, and oxygen-free aluminum-organic electrolyte is provided. The original device having an annularly shaped galvanizing trough, which is sealed from the atmosphere, and which utilizes a centrally located and rotatable contacting and holding mechanism for guiding the goods carriers around and through the electrolyte is herein provided with separate charging and discharging locks attached to the galvanizing trough. Each of the locks is provided with a U-shaped fluid lock to maintain the gaseous seal and an endless chain conveyor to transport the goods carrier to and from the galvanizing trough.

7 Claims, 4 Drawing Figures

DEVICE FOR GALVANIC PRECIPITATION OF ALUMINUM

BACKGROUND OF THE INVENTION

1. Field of the Invention

The present invention relates to a device for the galvanic precipitation of aluminum from aprotic, oxygen- and water-free, aluminum organic electrolytes. More particularly, the invention relates to such a device having a galvanizing tub, sealed from the outside and charged with a protective atmosphere, having an annularly closed galvanizing trough comprising a contacting and holding means within the tub, rotatable around a vertical axis of rotation and with support arms for good holders proceeding in a horizontal plane; and comprising separate charging and discharging passageways attached to the galvanizing tub, each consisting of a preliminary and a main chamber and having goods transfer devices, which are serviceable from the outside, disposed therein.

2. Description of the Prior Art

A galvanic precipitation device of this type has been disclosed by German Letters Patent No. 2,716,805. In this known device, the charging and discharging passageways are located above the galvanizing tub, and are subdivided into a preliminary and main chamber which are connected to one another by a sliding door. When the sliding door is opened, a hydraulically or pneumatically actuable workpiece transfer device provides for the introduction of the goods carriers or holders. With the annular design of the electrolyte trough, the goods carriers can move in a circular path through the electrolyte with the contacting and holding means and, given high current densities, can be coated with aluminum. Additionally, the annular design of the electrolyte trough makes possible the spatial separation of the feeding and removing of the goods carriers, using the charging and discharging passageways.

The contacting and holding device preferably exhibits a plurality of support arms, with the charging and discharging passageways matched to the divisional spacing of the carrying arms. Also, the various carrying arms can be separately supplied with an electrical current, so that different precipitation conditions can be selectively set for various work pieces. When so spatially arranged, the individual carrying arms can be loaded and/or unloaded simultaneously in a clock-like or pulsed manner without any great interruptions.

In this known device, the main chamber is designed as a condensation space and it is equipped with a spray device for spraying a solvent which is compatible with the electrolyte. The finished, galvanized goods can be freed of any adhering electrolyte residues in the primary chamber of the discharge passageway using this spray device.

In a preferred embodiment of the known device, a container for a pre-treatment bath is disposed in the preliminary chamber of the charging passageway (or lock), and a container for a post-treatment bath is located in the preliminary chamber of the discharging passageway (or lock). By so doing, the pre- and post-treatment of the work pieces may also be incorporated in the lock area of the galvanizing device which has been charged with a protective atmosphere. Thus, the economic feasibility, quality, and safety of the galvanic aluminization is further increased.

The disadvantages of this known galvanizing device include not only the complicated structure of the system, particularly of the work piece transfer device, which is a great hindrance to commercial exploitation on a large scale, but also the design of the passageway or lock is ineffective for keeping air and humidity away from the electrolyte, thus causing the slow deterioration of the electrolyte.

An aluminization cell has been disclosed in German OS No. 2,901,586, in which a lock system utilizing a fluid lock for the introduction and removal of the goods which are to be galvanized is provided. A preliminary chamber exhibiting a feed opening and which can be flooded with an inert gas precedes the fluid lock. The diffusion of oxygen and atmospheric humidity into the system can be prevented to a large extent with such a lock system. Using a continuous conveyor belt, the goods to be galvanized are introduced on goods frames or holders from the preliminary chamber which has been flooded with an inert gas into the galvanizing trough through the fluid lock. After galvanization they can be ejected from the trough with the assistance of the same conveyor belt in the reverse direction. The disadvantageous aspect of this known device is that a considerable amount of the electrolyte is carried out of the electrolyte trough and into the fluid lock. Due to this continuing contamination of the lock fluid with the electrolyte and thereafter the unavoidable reaction with traces of air and humidity in the preliminary chamber, flooded with inert gas, the reaction products precipitate at unfavorable locations on the goods which have been previously cleaned and are to be aluminum-coated. These are conveyed into the galvanizing space through the fluid which simultaneously functions as an entry and exit lock. These parts can no longer be coated with a technically usable aluminum coating. Additionally, such a cell for the aluminum galvanization of mass-produced goods is not economical, since only one goods holder—which cannot be uncoupled from the conveyor belt during the galvinization, can be coated.

SUMMARY OF THE INVENTION

The present invention has as an underlying objective to improve a device of the type which has been above-described, in such a manner that it is simpler in structure so that it can be economically employed for the aluminization of mass-produced goods. This would comprehend the simultaneous coating of a plurality of goods frames by providing the transporting of the goods frames or holders into the galvanizing area and successively transferred into their respective cathode devices. Additionally a relatively simple means is provided for the prevention of damage to the electrolyte due to contamination by air and humidity or by having some of the electrolyte conveyed out with the goods when they are removed. In view of the requirements for a technically good, flaw-free aluminization method, it must be guaranteed that the carefully pre-processed goods are not contaminated in the fluid lock prior to aluminization.

The resolution of these objectives is inventively achieved by providing a U-shaped fluid lock filled with an aprotic solvent to connect the preliminary and main chambers of the charging and discharging lock. The goods holders carrying the untreated goods are conveyed from the preliminary chamber, through the fluid lock, into the main chamber of the charging lock and then into the galvanizing trough. These goods holders are conveyed with the assistance of a continuous chain conveyor and are automatically delivered into the support arms of the supporting device in the galvanizing tank. After treatment of the goods, the goods holders are automatically removed from these support arms, (which also provide the electrical contact during galvanization), using a second endless chain conveyor. The goods holders are lifted out of the galvanization trough and are discharged via the fluid lock and the preliminary chamber of the discharging lock.

In comparison to the known structure as disclosed in German OS No. 5,716,805, the inventive device differs by having the preliminary and main chambers of the charging and discharging locks not connected to one another by a sliding door, but instead by a fluid lock. The inventive use of this fluid lock permits the complete gaseous separation of the preliminary chamber from the main chamber, and makes the introduction of air and humidity into the main chamber practically impossible. One embodiment of this principle provides the primary or main chamber be located above the level of the electrolyte and preferably be designed to serve as a solvent condensation space. A preliminary lock which can be flooded with an inert gas is placed next to the main chamber and communicates therewith by means of a common, vertical partition which extends partway into a trough containing an inert fluid, thus forming a gas seal.

With the assistance of endless chain conveyors, which are well known to the art, the goods holders carrying the goods are introduced into the galvanizing trough after first passing through the preliminary lock, (which has been flooded with an inert gas), and then into the main chamber (also filled with an inert gas), after passing through the U-shaped fluid lock. The goods holders are thus automatically delivered to the galvanizing trough and into the carrying arms of the supporting device of the galvanizing tub.

Since the goods to be galvanized must be introduced into the aluminum electrolyte in an immaculately clean state, it is absolutely necessary that the inert fluid of the fluid lock in the charging lock or passageway not be contaminated. Most importantly, no solids must form in this fluid since these would later detrimentally affect the adhesion of the galvanic coating to the surface of the goods. Such solids could also effect the formation of pores in the coating.

The occurrence of solid aluminum compounds (hydroxides) in the inert fluid must therefore be avoided. Such solids formation may be caused by residual amounts of the aluminum electrolyte remaining on the galvanized goods when pulled from the bath and transferred to the outer chamber, through the inert fluid lock. The residual electrolyte is washed off by the inert fluid and becomes intermixed therein, where it eventually reacts with air and water vapor infiltrating from the outside.

This particular problem may be simply and adequately solved according to the present invention, and in view of German OS No. 2,901,586, by providing a discharging lock in addition to the charging lock, with the discharging lock being given essentially the same structure. In addition to the advantage of eliminating the possibly tedious filtrations at the charging lock, a further advantage is derived. A considerable economic efficiency occurs because an aluminization system provided with two locks can potentially be simultaneously loaded with goods holders, as well as emptied of the same, in phase.

The automatic transfer or removal of the goods holders to and/or from the support arms of the contacting and holding device can be accomplished in an advantageous manner by providing the goods holders with a transport rod. Hook-shaped dogs of the chain conveyor may engage with the rod, and the ends of the rod are designed as support and contacting pegs. These ends interact with the correspondingly socket-shaped end of the fork-shaped support arms of the contacting and holding device. Preferably, the cross-section of the support and contacting pegs as well as the socket-shaped ends of the support arms have an angular profile, thereby permitting a good current transfer.

As is disclosed in German Letters Patent 2,716,805, a rinsing zone is also provided in an embodiment of the inventive device. This zone is located between the galvanization trough and the fluid lock of the discharging lock or passage. The discharge opening for the goods holder in the galvanization trough is advantageously provided with a shaft-shaped condensation space which is connected to the main chamber of the discharging lock. Solvent with alkyl vapors is thereby prevented from reaching the inert fluid of the fluid lock.

The shaft-shaped condensation space preferably contains spray nozzles for spraying a solvent which is compatible with the electrolyte. The inert fluid in the fluid lock of the discharging lock is thus contaminated only slightly due to this cleaning of the goods and goods holders after the galvanic aluminization. Also, the aluminized goods carriers or holders can advantageously be cleaned in the condensation space directly after leaving the electrolyte bath. This permits the amount of the aluminum electrolyte which escapes to be kept as low as possible.

Various other objects, advantages, and features of the present invention will become readily apparent from the ensuing detailed description and the novel features will be particularly point out in the appended claims.

DESCRIPTION OF THE PREFERRED EMBODIMENTS

Figure 1:
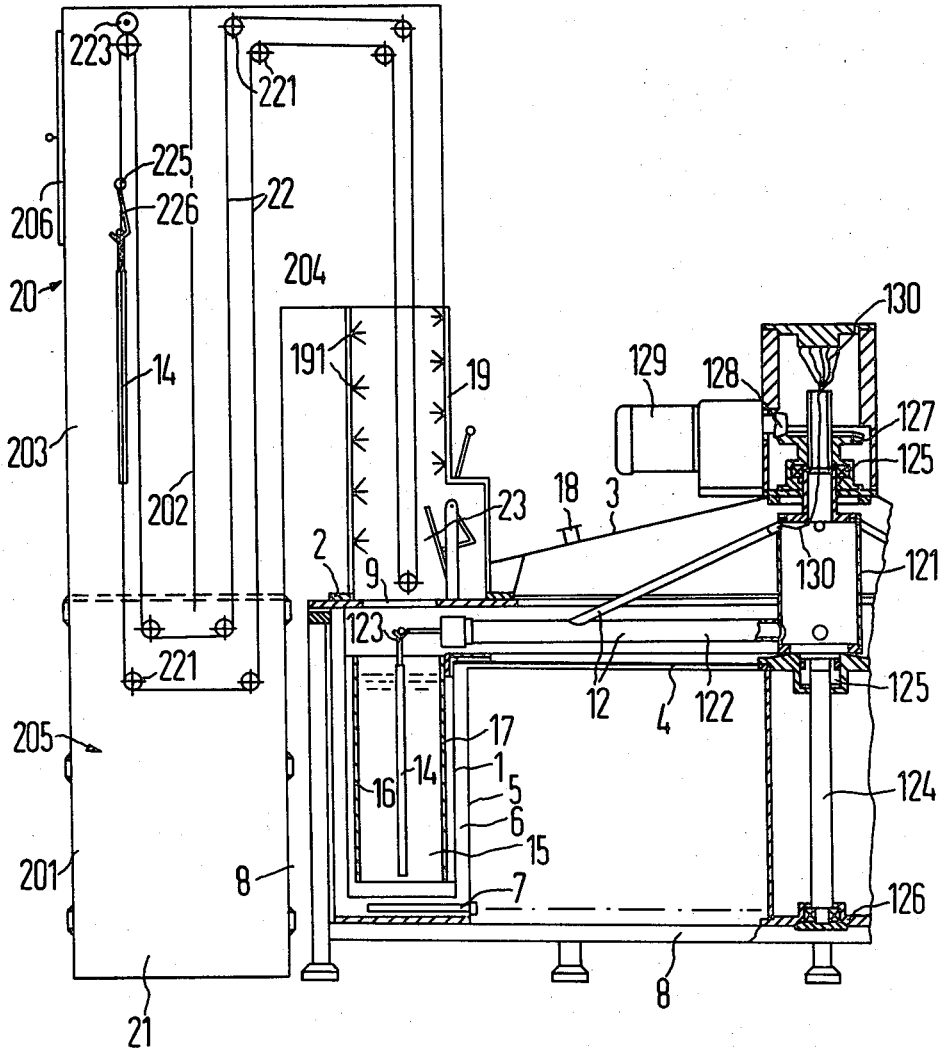
FIG. 1 is a side elevational view, partially in section, showing a portion of a galvanizing device according to the present invention.
Figure 2:
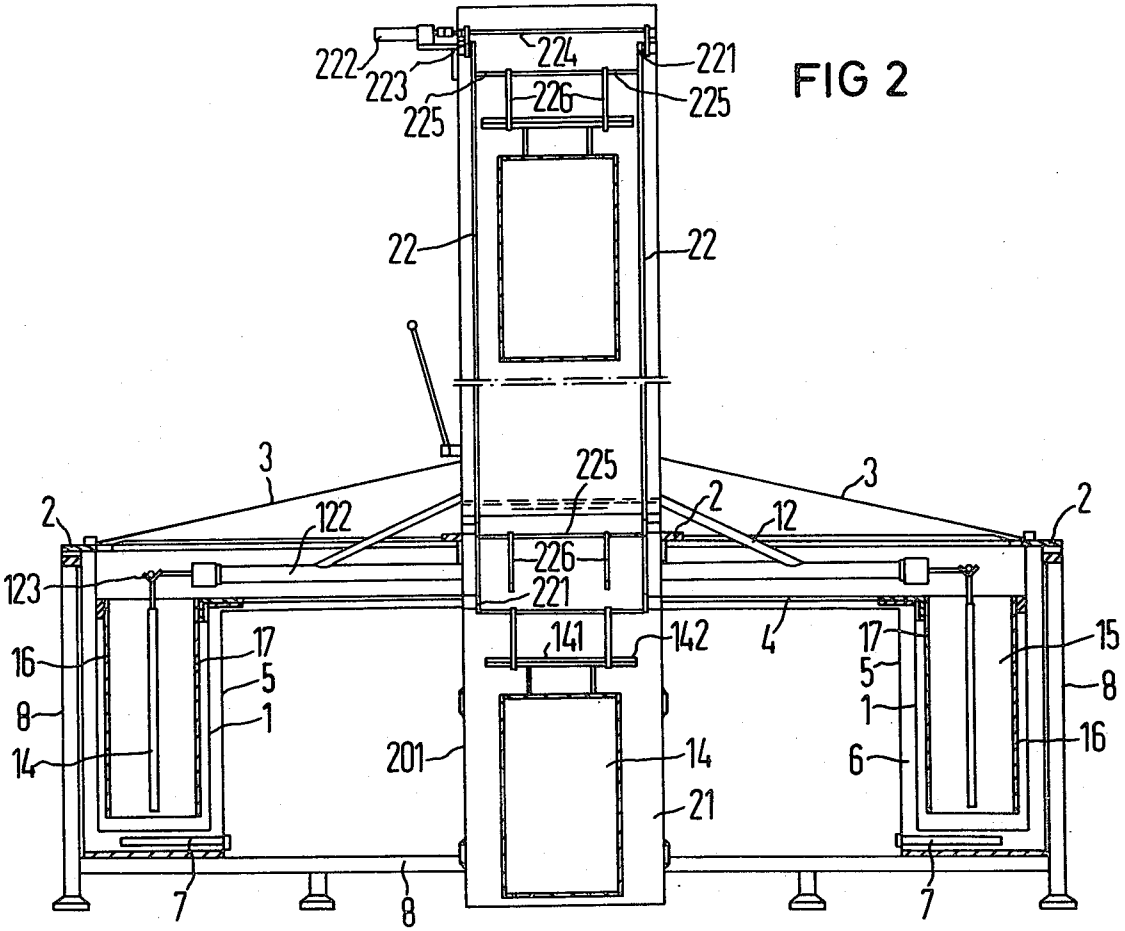
FIG. 2 is a side elevational view showing in full a galvanizing device according to FIG. 1.
Figure 3:
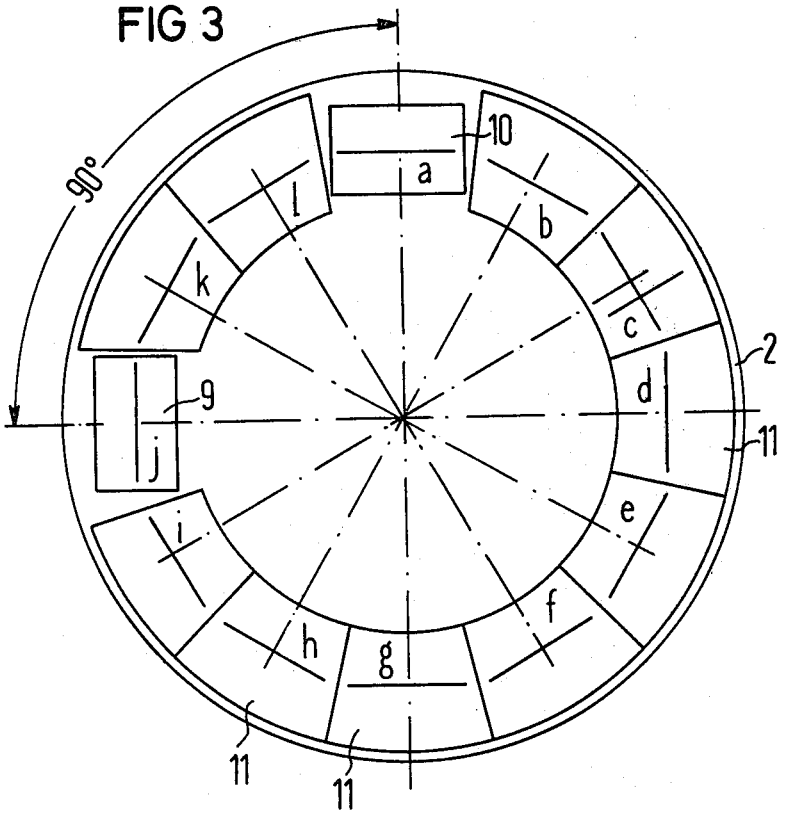
FIG. 3 is a top plan view showing schematically a galvanization tank according to the present invention.

FIGS. 1 and 2 show the galvanization tank of the present invention, consisting of an annular and rotational-symmetrically designed electrolyte trough 1, with an upper closing cover 2 and upper closing cap 3, and a lower closing cap 4. The electrolyte trough 1 is suspended in a heating vat 5, which is likewise annularly and rotational-symmetrically designed. The heating vat 5 serves as a receptacle for a heating bath 6, which, for example, may be an oil bath. As is illustrated in FIGS. 1 and 2, heat may be supplied to the heating bath 6 by cartridge-type heaters 7, or, though not illustrated, by a separate heating circuit through which a heated fluid circulates. The electrolyte trough 1 and the heating vat 5 are suspended together in a frame 8, which supplies the needed, over-all static stability. The upper closing cover 2, which is also essentially annularly designed, is flanged to the cylindrical outside wall of the electrolyte trough 1, said upper closing cover 2, being in turn connected to the upper closing cap 3. The upper closing cover 2 exhibits two inside lock openings 9 and 10, angularly displaced by 90° as is shown in FIG. 3. Only the lock opening 9 in the closing cover 2 is shown in FIG. 1.

As shown in FIG. 3, openings a-l distributed around the circumference of the upper closing cover 2 are closed by means of removable cover segments 11. The lower closing cap 4 is flanged to the cylindrical inside wall of the electrolyte trough 1 which exhibits a low height in comparison to the outside wall. A free space between the upper closing cover 2 and the upper closing cap 3 on the one hand and the lower closing cap 4 on the other hand arises in the galvanization vat due to the different heights of the outside wall and inside wall of the electrolyte trough 1. This free space is provided to accommodate a contacting and holding device which has been assigned an overall reference numeral 12. The contacting and holding device 12 consists of a rotor 121 with a total of twelve uniformly spaced carrying or support arms 122 attached thereto and having receptive pick-ups 123 at their fork-shaped ends. A shaft 124 of the rotor 121 is centrally aligned with respect to the electrolyte trough, and is rotatably seated with the assistance of two gas-tight, face-type end shields 125 and is supported toward the bottom by a thrust bearing 126 which is connected to the frame 8.

The drive of the rotor 121 is carried out above the upper closing cap 3 by a drive motor 129, with bevel wheels 127 and 128. The particular drive motor 129 is selected as having an explosion-proof design. Each of the 12 support arms 122 exhibits a separate cathode terminal 130. In FIG. 1, only the cathode terminal for the support arm 122 lying in the cutting plane of FIG. 1 is illustrated in the drawing. The connection of the cathode terminals 130 to their specific pickups 123 can be, for example, by carbron brushes and slip rings. This possibility, and other known methods are not illustrated in greater detail in the drawings.

Figure 4:
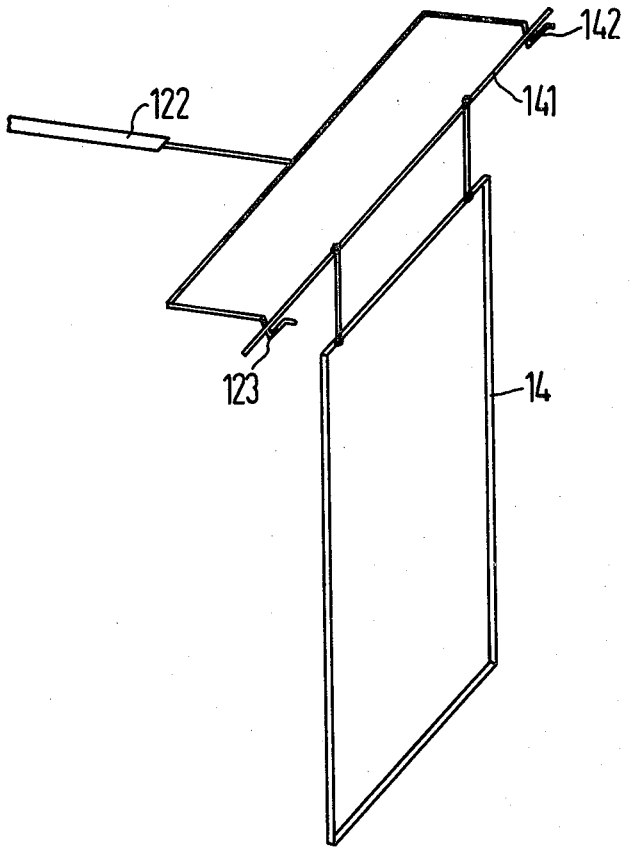
FIG. 4 is a view in perspective of a goods carrier or holder.

As can be seen in greater detail on the basis of FIG. 4, the free ends of the support arms 122 are designed as branched or fork-shaped, and have the pickups 123 at each ends. These pickups 123 are provided with a triangular profile in order to assure a good electrical contact. The correspondingly designed ends of the transport rod 141, provided with a goods holder or carrier 14, can be hooked or attached to said pickups 123. The current transfer is promoted due to the angular profile of the contacting pegs 142 and the correspondingly angularly designed pickups 123. The goods holders 14 can, for example, consist of a type of frame in which the work pieces to be aluminized are secured with the assistance of electrically conductive support wires.

With the rotary motion of the contacting and holding device 12, the work pieces can be conducted on a circular path through an electrolyte 15 situated in the electrolyte trough 1. Outer anode segments 16 are disposed in an outer ring and inner anode segments 17 are disposed in an inner ring, both at equal distances from the circulatory path of the goods holders 14. The outer anode segments 16 may be secured by intermediate insulating pieces (not shown) to the outer wall of the electrolyte trough 1, and the inner anode segments may likewise be secured by intermediate insulating pieces (not shown) to the inside wall of the electrolyte trough 1. The electrical current supply (not illustrated in the drawing) to the outer and inner anode segments 16 and 17 respectively may be provided in a manner which is standard in plating technology, for example by cables which are passed through the walls of the electrolyte trough 1 and the heating vat 5 using electrically insulating seals. The aforementioned, removable cover segments 11 of the upper closing cover 2, make possible a rapid interchange of the anode segments 16 and 17 and also a change in the anode spacing.

In order to protect the anhydrous, oxygen-free aluminum organic electrolyte 15, the galvanization vat is charged with a dry, protective gas which may be supplied through a nozzle 18, in the upper closing cap 3. The gas flowage is metered in such manner that it is always under a slight overpressure. In this manner, the air space formed in the galvanization vat is charged with a protective atmosphere which is closed toward the outside. To preserve this atmosphere necessitates that the introduction and/or removal of the goods holders 14 be made only through the aforementioned inner lock openings 9 and 10. So that no ambient air can penetrate into the galvanization vat at these locations either, a shaft-shaped condensation space 19 is provided above the inner lock opening 9, a charging lock 20 (shown in FIG. 1) being connected to said condensation space 19. In an analogous manner (though not shown in the illustrations) the inner lock opening 10 is also provided with a condensation space and a discharging lock which corresponds to the condensation space 19 and the charging lock 20.

The charging lock 20 consists of a container 201 having a rectangular base in which an aprotic solvent 21 is situated. The container 201 is subdivided into a preliminary chamber 203 and a main chamber 204 by a partition 202, which extends downwardly into the solvent 21. The main chamber 204 forms a continuous, sealed attachment with the condensation space 19. Thus, the solvent 21 and the partition 202 partially extending into said solvent 21 form a fluid lock 205 which makes the infiltration of air and humidity into the main chamber 204, and thus into the electrolyte 15, extremely difficult or impossible, even disregarding the fact that the preliminary chamber 203 has been flooded with an inert gas. The preliminary chamber 203 is provided with an input opening 206 (which can be closed vacuum-tight) for the goods carriers 14. The goods carriers 14 can then be transferred with the assistance of an endless conveyor chain 22, from the preliminary chamber 203, through the fluid lock 205, and into the main chamber 204. From there, the goods holders 14 may be lowered into the galvanizing vat via the condensation space 19. As can particularly be seen in FIG. 2, two conveyor chains 22 are provided, parallel to one another and attached to rollers 221 located on opposite side walls of the container 201. The conveyor chains 22 are capable of being driven in common, a gear motor 222 driving a shaft 224 using a transmission 223. Cross-arms 225 are disposed between and attached to the conveyor chains 22, said cross-arms 225 automatically seizing the transport rods 141 of the goods holders 14 with carrier hooks 226, and then depositing them in the pickups 123 of the support arms 122.

In order to load the galvanizing vat with goods holders 14, the input opening 206 of the preliminary chamber 203, which has been preferably previously flooded with inert gas, is opened. A goods holder 14, holding the goods to be galvanized, is suspended on the conveyor chains 22 by the carrier hooks 226, and the input opening 206 is again closed. Subsequently, the conveyor chains are placed in motion, whereby the goods holder 14 is conveyed through the fluid lock 205 and into the main chamber 204. Conveyance continues and the goods holder 14 is delivered to the pickups 123 of the carrying arms 122, where the carrier hooks 226 automatically release from the transport rod 141.

The removal of the goods carriers 14 from the electrolyte trough 1 ensues in a similar manner, the only difference being that the conveyor chains 22 move in the opposite direction. The carrier hooks 226 automatically grasp the transport rod 141 of the goods holders 14 and convey them to a discharge opening (not shown) located analogously in a discharging lock. As needed, the inner lock openings 9 and 10 can each also be closed from the outside with the assistance of covers 23, which can be operated from the outside. This can be necessary, for example, when the main chamber 204 must be aired out for various reasons.

At the discharging lock the condensation space 19 is equipped with spray nozzles 191 for the purpose of spraying or rinsing the galvanized goods and the goods holders 14 with a solvent which is compatible with the electrolyte 15. As needed, the cover 23 can also be closed for rinsing the goods, and the solvent employed for the spraying can be provided with its own circulatory system.

While we have disclosed an exemplary structure to illustrate the principles of the invention, it should be understood that we wish to embody within the scope of the patent warranted hereon all such modifications as reasonably and properly come within the scope of our contribution to the art.

We claim as our invention:

1. An improved galvanizing device for the galvanic precipitation of aluminum from an anhydrous, aprotic, and oxygen-free aluminum-organic electrolyte of the type having an annularly shaped galvanizing trough, which is sealed from the atmosphere and chargeable with a protective gas, and a rotatable contacting and holding device, located at a vertical rotational axis of the trough, the device having a plurality of support arms radiating outwardly from the rotational axis, with goods carriers able to be selectively attached to the support arms for passage around and through the galvanizing trough, wherein the improvement comprises:

a charging lock; and a discharging lock, both of said locks attached to the galvanizing trough and each comprising:

a preliminary chamber, a main chamber, a U-shaped fluid lock connecting said preliminary chamber to said main chamber, forming a gaseous seal, and an endless chain conveyor attached to and running continuously through the preliminary chamber, the main chamber, and the fluid lock, whereby the goods carriers may be conveyed through the chambers of the charging lock, into the galvanizing trough, and through the discharging lock, thereby maintaining the protective atmosphere of the galvanizing trough.

2. An improved galvanizing device as described in claim 1, and further comprising:

a plurality of carrying hooks selectively attached to the endless chain conveyor;

a horizontal transport rod attached to each goods carrier; and a socket-shaped pickup attached to the outer end of the support arms for receiving and holding the transport rod of the goods carrier, whereby the transport rods engage with the carrying hooks for conveyance to and engagement with the support arms, and later re-engage with the hooks for the return conveyance.

3. An improved galvanizing device as described in claim 2, wherein the portion of the transport rods engaging with the socket shaped pickup, and the socket shaped pickup exhibit corresponding, compatible angular profiles, to insure electrical contact.

4. An improved galvanizing device as described in claim 1, and further comprising:

a rinsing means provided between the galvanizing trough and the U-shaped fluid lock of the discharging lock.

5. An improved galvanizing device as described in claim 1, and further comprising:

a shaft located between and connected to both the main chamber and the galvanizing trough, providing condensation space.

6. An improved galvanizing device as described in claim 5, and further comprising:

a plurality of spray nozzles disposed in the condensation space of the discharging lock for spraying a solvent which is compatible with the electrolyte.

7. An improved galvanizing device as described in claim 6, and further comprising:

means for providing re-circulation of the rinsing solvent used by said spray nozzles.

* * * * *